US011702868B2

(12) United States Patent
Gallegos et al.

(10) Patent No.: US 11,702,868 B2
(45) Date of Patent: Jul. 18, 2023

(54) HOOD SAFETY SYSTEM FOR A VEHICLE

(71) Applicant: Ningbo Geely Automobile Research & Development Co., Ltd., Ningbo (CN)

(72) Inventors: David Gallegos, Gothenburg (SE); Siet-ming Law Hing Ping, Gothenburg (SE)

(73) Assignee: NINGBO GEELY AUTOMOBILE RESEARCH & DEVELOPMENT CO., Ningbo (CN)

( * ) Notice: Subject to any disclaimer, the term of this patent is extended or adjusted under 35 U.S.C. 154(b) by 293 days.

(21) Appl. No.: 17/133,978

(22) Filed: Dec. 24, 2020

(65) Prior Publication Data

US 2021/0115708 A1 Apr. 22, 2021

Related U.S. Application Data

(63) Continuation of application No. PCT/CN2019/090252, filed on Jun. 6, 2019.

(30) Foreign Application Priority Data

Jul. 2, 2018 (EP) ..... 18181224

(51) Int. Cl.
*E05B 77/04* (2014.01)
*E05B 83/24* (2014.01)
*E05B 85/26* (2014.01)

(52) U.S. Cl.
CPC ..... *E05B 77/04* (2013.01); *E05B 83/24* (2013.01); *E05B 85/26* (2013.01)

(58) Field of Classification Search
CPC ..... E05B 77/02; E05B 77/04; E05B 77/06; E05B 77/08; Y10S 292/22
See application file for complete search history.

(56) References Cited

U.S. PATENT DOCUMENTS 5,308,130 A * 5/1994 Lee ..... E05B 77/12 292/229
10,273,728 B2 * 4/2019 Nam ..... E05B 77/06
(Continued)

FOREIGN PATENT DOCUMENTS

CN 104563679 A 4/2015
CN 104790777 A 7/2015
(Continued)

OTHER PUBLICATIONS

Computer Generated Translation for DE 102008039731, Generated on Dec. 8, 2022, https://worldwide.espacenet.com/ (Year: 2022).*
(Continued)

*Primary Examiner* — Alyson M Merlino
(74) *Attorney, Agent, or Firm* — Tucker Ellis LLP

(57) ABSTRACT

A hood safety system for a vehicle prevents a hood of the vehicle from being unlocked in a crash event. The system includes a hood locking mechanism and a crash safety mechanism attached to a front structure in a front section of the vehicle. The hood locking mechanism may manually release the hood from a locked position to an unlocked position. The crash safety mechanism includes a crash pin displaceable between an inactivated state and an activated state. In the inactivated state the crash pin is disengaged from the hood locking mechanism and, in the activated state, the crash pin engages the hood locking mechanism to prevent the hood locking mechanism from displacing the hood into the unlocked position. A front section of the vehicle, when deformed by a crash event, is configured to mechanically displace the crash pin from the inactivated state to the activated state.

13 Claims, 9 Drawing Sheets

(56) References Cited

U.S. PATENT DOCUMENTS

| | | | | |
|---|---|---|---|---|
| 11,384,571 | B2 * | 7/2022 | Obita | E05B 77/04 |
| 2006/0261603 | A1 * | 11/2006 | Cetnar | E05B 77/06 292/216 |
| 2012/0217761 | A1 | 8/2012 | Nakamura | |
| 2014/0159386 | A1 | 6/2014 | Mohammed | |
| 2014/0284940 | A1 | 9/2014 | Rosales | |
| 2014/0284941 | A1 | 9/2014 | Wittelsbuerger | |
| 2014/0319848 | A1 * | 10/2014 | Fannon | E05B 83/24 292/122 |
| 2019/0301208 | A1 * | 10/2019 | Cimpean | E05B 77/04 |
| 2020/0386013 | A1 * | 12/2020 | Strathmann | E05B 77/04 |

FOREIGN PATENT DOCUMENTS

| | | | | |
|---|---|---|---|---|
| DE | 19825708 | A1 * | 3/1999 | E05B 77/06 |
| DE | 102008039731 | A1 * | 3/2010 | E05B 77/08 |
| DE | 102008039731 | A1 | 3/2010 | |
| DE | 102008057883 | A1 | 5/2010 | |
| DE | 102009041744 | B4 * | 6/2013 | E05B 77/04 |
| DE | 102012025053 | A1 * | 6/2014 | E05B 77/04 |
| KR | 20170021996 | A * | 3/2017 | E05B 77/08 |

OTHER PUBLICATIONS

International Search Report from corresponding International Application No. PCT/CN2019/09252, dated Sep. 6, 2019, 2 pages.

* cited by examiner

HOOD SAFETY SYSTEM FOR A VEHICLE

RELATED APPLICATION DATA

This application is a continuation of International Patent Application No. PCT/CN2019/090252, filed Jun. 6, 2019, which claims the benefit of European Patent Application No. 18181224.9, filed Jul. 2, 2018, the disclosures of which are incorporated herein by reference in their entireties.

TECHNICAL FIELD

The present disclosure relates to a hood safety system for a vehicle preventing a hood of the vehicle from being unlocked in a crash event, comprising a hood locking mechanism attached to a front structure in a front section of the vehicle, where the hood locking mechanism through manual action from a user is configured to releasing the hood of the vehicle from a locked position to an unlocked position. The disclosure further relates to a method for preventing the hood from being unlocked in a crash event, and a vehicle comprising a hood safety system.

BACKGROUND

If a hood of a vehicle is being deformed in a crash event, it is a high risk that the hood is being unintentionally opened if not being properly secured to a front section of the vehicle. The hood is normally locked to the front section with a hood locking mechanism that is locking the hood and preventing that the hood is unintentionally opened, for example during driving, or opened by unauthorized persons, for example when the vehicle is parked. The hood locking mechanism is also designed to unlock the hood for giving access to the engine compartment or the storage compartment of the vehicle, depending on the construction of the vehicle.

There are mainly two different systems and methods for unlocking vehicle hoods, such as car hoods, that are used on today's vehicles on the market. Due to safety regulations, the systems use a two-step opening process, where the hood is opened through a double action from a user of the vehicle. There are mainly two different systems on the market, the single-pull hood latch system and the double-pull hood latch system.

Single-pull hood latch systems are opening a hood locking mechanism from a locked position to an intermediate locked position through a single-pull action from the user. When the user is pulling an opening handle arranged in the interior structure of the car, the hood locking mechanism is opened to the intermediate locked position. To further move the hood locking mechanism into an unlocked position, a manual action from the user is required, and often a safety catch arranged in connection to the hood locking mechanism at the front section of the car must be released to open the hood.

Double-pull hood latch systems are opening the hood locking mechanism from the locked position to the unlocked position through a double-pull action from the user. When the user is pulling the opening handle in a first sequence, the hood locking mechanism is opened from the locked position to the intermediate locked position. Thereafter, the opening handle needs to be released and then pulled again in a second sequence to move the hood locking mechanism from the intermediate locked position to the unlocked position. With the double-pull system the user is not required to release a safety catch arranged at the front section of the car, which simplifies the opening of the hood, and further eliminates the need for manually opening the hood in front of the car, which many times are complicated and risking that the user's hands or clothes are getting soiled. The double-pull systems are considered to provide a more simplified opening of the hood with a premium feeling compared to the single-pull systems. However, since double-pull systems are not constructed with a safety catch, like single-pull systems, they are considered to be less safe in accidents or crash situations.

There is thus a need for an improved hood opening system and method for hood latch systems where the opening system has a safety level comparable to single-pull systems with a safety catch, where the premium feeling and convenient opening procedure as with traditional double-pull systems used on the market today are achieved.

SUMMARY

An object of the present disclosure is to provide a hood safety system for a vehicle, a method for preventing a hood of a vehicle from being unlocked in a crash event, and a vehicle, where the previously mentioned problems are avoided. This object is at least partly achieved by the features of the independent claims. The dependent claims contain further developments of the hood safety system.

The disclosure concerns a hood safety system for a vehicle preventing a hood of the vehicle from being unlocked in a crash event, comprising a hood locking mechanism and a crash safety mechanism attached to a front structure in a front section of the vehicle. The vehicle is extending in a longitudinal direction and a lateral direction. The hood locking mechanism is through manual action from a user configured to releasing the hood of the vehicle from a locked position to an unlocked position. The crash safety mechanism comprises a crash pin displaceable between an inactivated state and an activated state, where in the inactivated state the crash pin is disengaged from the hood locking mechanism, and where in the activated state the crash pin is engaging the hood locking mechanism preventing the hood locking mechanism from displacing the hood into the unlocked position. The front section of the vehicle is when being deformed in a crash event configured to mechanically displace the crash pin from the inactivated state to the activated state.

The hood safety system is providing a solution where the safety level of the system is comparable to single-pull systems with a safety catch, since the crash pin is acting as an auxiliary safety feature in the crash event. The crash pin is engaging the hood locking mechanism and preventing the hood locking mechanism from displacing the hood into the unlocked position through the deformation of the front section of the vehicle, where the front section in the crash event is configured to mechanically displace the crash pin from the inactivated state to the activated state. The crash pin is a simple and reliable construction that is only activated in the crash event and the simple and convenient opening procedure system can be used if desired, as well as providing the premium feeling of a double-pull system. With the system, the use of a safety catch in the hood locking mechanism is avoided and therefore there is no need for the user to manually release the hood locking mechanism at the front section of the car for opening the hood. The unlocking of the hood can with the system be established through a simple unlocking procedure, where the unlocking of the hood easily can be achieved from inside the vehicle compartment without the need for manual unlocking operations externally.

According to an aspect of the disclosure, the crash pin has a front part arranged to engage the front section of the vehicle during the crash event, and a rear part arranged to engage the hood locking mechanism in the activated state. With this construction, the crash pin is arranged for interacting with both the front section of the vehicle and the hood locking mechanism through the front part and the rear part of the crash pin respectively. Since the front section of the vehicle is being deformed in the crash event, the front part of the crash pin will interact with the front section. Through this interaction the crash pin is mechanically displaced from the inactivated state to the activated state.

According to another aspect of the disclosure, the front part of the crash pin is provided with a pressure plate, where the pressure plate is arranged to engage the front section of the vehicle during the crash event. The pressure plate is distributing the deformation force of the front section over a larger area, securing that the crash pin is having the desired displacement during the crash event.

According to other aspects of the disclosure, the crash pin has an elongated shape extending in a direction along an axis, where the axis of the crash pin is extending in the longitudinal direction of the vehicle, and the crash pin during the crash event is arranged to translate in the longitudinal direction of the vehicle from the inactivated state to the activated state. The elongated shape is providing a strong constructional design of the crash pin where the crash pin can be made with a simple and robust configuration. The extension in the longitudinal direction of the vehicle is securing the displacement of the crash pin in the right direction during the crash event, so that the crash pin is translating in the longitudinal direction of the vehicle from the inactivated state to the activated state.

According to a further aspect of the disclosure, the hood locking mechanism is cooperating with a striker attached to the hood, where the hood locking mechanism comprises a latch and a pawl. In the locked position of the hood the latch is engaging the striker and the pawl is locking the latch, preventing the hood from being unlocked. In the unlocked position of the hood the pawl is unlocking the latch allowing the striker from being disengaged from the latch. The components of the hood locking mechanism is providing a simple and reliable construction of the system, where the different parts are used for both locking the hood and unlocking the hood.

According to an aspect of the disclosure, the pawl is provided with a pawl body extending in the lateral direction of the vehicle, where the pawl body is provided with a pawl opening for receiving the crash pin. The crash pin is in the activated state engaging the pawl opening preventing the hood locking mechanism from releasing the hood to the unlocked position. The engagement of the pawl is providing a simple and reliable construction of the system, where the hood locking mechanism in the crash event is preventing that the hood is displaced into the unlocked position.

According to another aspect of the disclosure, the latch is provided with a latch body extending in the lateral direction of the vehicle, where the latch body is provided with a latch opening for receiving the crash pin. The crash pin is in the activated state engaging the latch opening preventing the hood locking mechanism from releasing the hood to the unlocked position. The engagement of the latch is providing a simple and reliable construction of the system, where the hood locking mechanism in the crash event is preventing that the hood is displaced into the unlocked position.

According to a further aspect of the disclosure, the striker is provided with a striker opening for receiving the crash pin, wherein the crash pin in the activated state is engaging the striker opening preventing that the hood is released to the unlocked position. The engagement of the striker is providing a simple and reliable construction of the system, where the hood locking mechanism in the crash event is preventing that the hood is displaced into the unlocked position.

According to an aspect of the disclosure, the crash safety mechanism further comprises a front guide part, where the front guide part is arranged for guiding the crash pin during the crash event. The front guide part is securing that the displacement of the crash pin during the crash event is achieved in a correct manner so that the crash pin is engaging the hood locking mechanism and preventing that the hood locking mechanism is displacing the hood into the unlocked position.

According to another aspect of the disclosure, the front guide part is attached to the front structure of the vehicle in front of the hood locking mechanism, and has a tubular shape extending in the longitudinal direction of the vehicle, where the crash pin is extending inside the front guide part in the inactivated state and the activated state, and where the front guide part is guiding the crash pin in the longitudinal direction when the crash pin is displaced from the inactivated state to the activated state. The crash pin is arranged inside the front guide part, and the tubular shape is used for guiding the crash pin during the crash event when the front section is deformed. The tubular construction is providing a simple and reliable design of the front guide part.

According to a further aspect of the disclosure, a front end of the front guide part is provided with a stop plate, where the stop plate is arranged for preventing further movement of the crash pin when the crash pin has reached the activated state, where in the activated state the stop plate is engaging the pressure plate of the crash pin. The stop plate is securing that the crash pin is not displaced a too long distance, which could cause a malfunction of the system during the crash event. If for example the crash pin is moving past the hood locking mechanism, the desired function is not achieved. The stop plate of the front guide part is interacting with the pressure plate so that the crash pin has the correct locking position in the crash event.

According to an aspect of the disclosure, the crash safety mechanism further comprises a rear guide part, where the rear guide part is arranged for guiding the crash pin during the crash event. The rear guide part is securing that the displacement of the crash pin during the crash event is achieved in a correct manner so that the crash pin is engaging the hood locking mechanism and preventing that the hood locking mechanism is displacing the hood into the unlocked position.

According to another aspect of the disclosure, the rear guide part is attached to the front structure of the vehicle behind the hood locking mechanism, and has a tubular shape extending in the longitudinal direction of the vehicle, where the crash pin in the activated state is extending inside the rear guide part, and where the rear guide part is guiding the crash pin in the longitudinal direction when the crash pin is displaced from the inactivated state to the activated state. The crash pin is arranged inside the rear guide part in the activated state, and the tubular shape is used for guiding the crash pin during the crash event when the front section is deformed. The tubular construction is providing a simple and reliable design of the rear guide part.

According to a further aspect of the disclosure, the hood locking mechanism is a double pull-action hood unlocking mechanism, where the hood locking mechanism through a manual double-pull action from the user is releasing the hood of the vehicle from the locked position to the unlocked position. Double-pull hood latch systems are opening the hood and the hood locking mechanism from a locked position to an unlocked position through a double-pull action from the user, and with the double-pull system the user is not required to release a safety catch arranged at the front section of the car which simplifies the opening of the hood and further eliminates the need for manually opening the hood in front of the car. The double-pull systems are providing a simple opening of the hood with a premium feeling.

The disclosure further concerns a method for preventing a hood of a vehicle from being unlocked in a crash event, where the vehicle comprises a hood safety system with a hood locking mechanism and a crash safety mechanism attached to a front structure in a front section of the vehicle, the vehicle extending in a longitudinal direction and a lateral direction, where the hood locking mechanism through manual action from a user is configured to releasing a hood of the vehicle from a locked position to an unlocked position. The crash safety mechanism comprises a crash pin displaceable between an inactivated state and an activated state, where in the inactivated state the crash pin is disengaged from the hood locking mechanism, and where in the activated state the crash pin is engaging the hood locking mechanism preventing the hood locking mechanism from displacing the hood into the unlocked position. The method is comprising the step; mechanically displacing the crash pin from the inactivated state to the activated state through deformation of the front section of the vehicle in a crash event.

The method is providing a safe and reliable solution where the crash pin is mechanically displaced from the inactivated state to the activated state through deformation of the front section of the vehicle in the crash event.

The disclosure further concerns a vehicle comprising a hood safety system as described above.

BRIEF DESCRIPTION OF THE DRAWINGS

The disclosure will be described in greater detail in the following, with reference to the attached drawings, in which.

REFERENCE SIGNS

Figure 1:
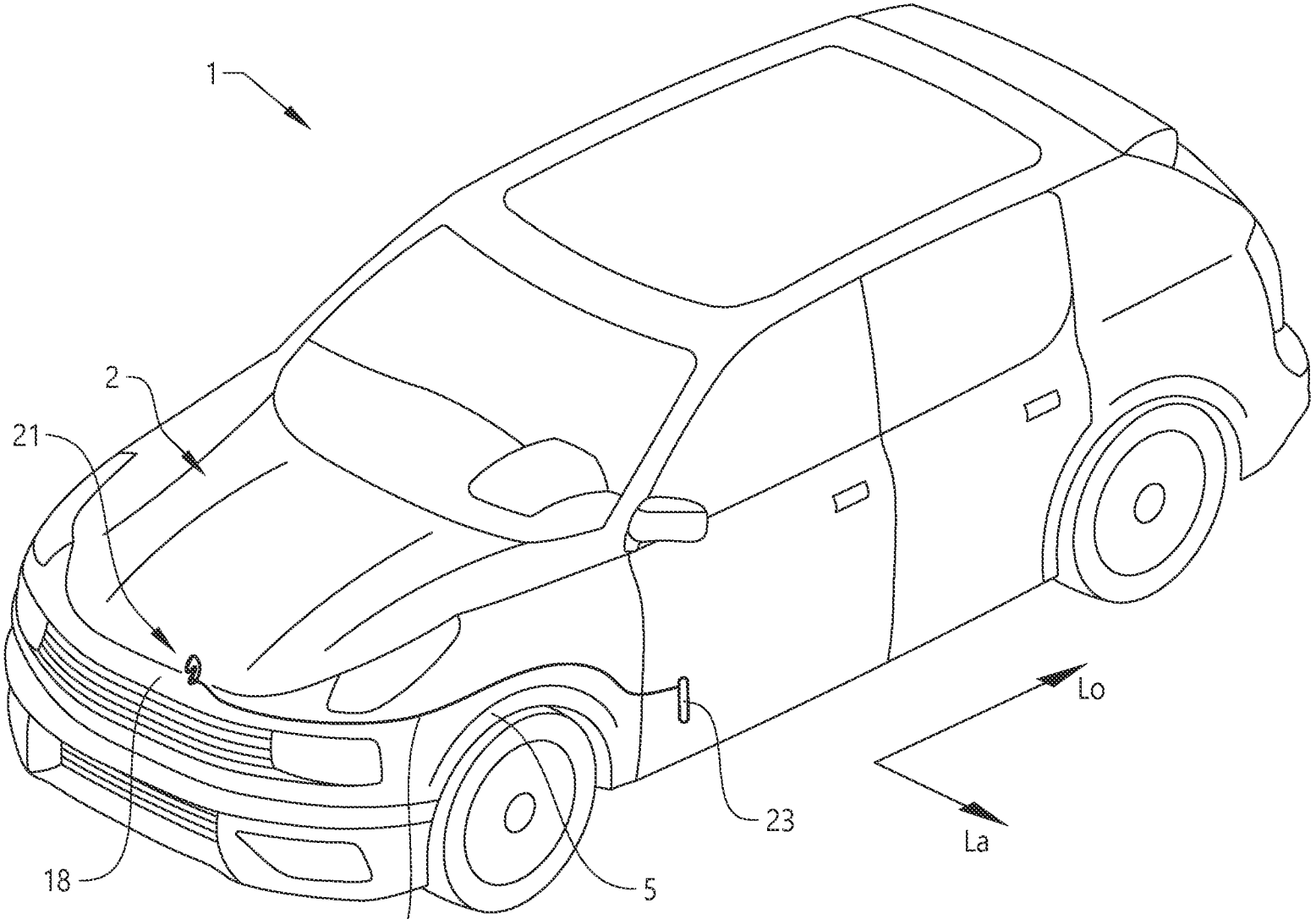
FIG. 1 shows schematically, in a perspective view a vehicle with a hood safety system according to the disclosure.

1: Vehicle
2: Hood
3: Hood locking mechanism
4: Crash safety mechanism
5: Front section
6: Striker
7: Latch
7*a*: Latch axis
8: Pawl
8*a*: Pawl axis
9: Crash pin
10: Front part, crash pin
11: Rear part, crash pin
12*a*: Pawl body
12*b*: Latch body
13*a*: Pawl opening
13*b*: Latch opening
14: Striker opening
15: Pressure plate
16: Front guide part
17: Rear guide part
18: Front structure
19: Front end
20: Stop plate
21: Hood safety system
22*a*: First pawl locking surface
22*b*: Second pawl locking surface
23: Opening handle
24: Bowden cable
25: Inner deformation surface
26: Crash pin body
27: Spring arrangement

DETAILED DESCRIPTION

Various aspects of the disclosure will hereinafter be described in conjunction with the appended drawings to illustrate and not to limit the disclosure, wherein like designations denote like elements, and variations of the described aspects are not restricted to the specifically shown embodiments, but are applicable on other variations of the disclosure.

FIG. 1 schematically shows in a perspective view a vehicle 1 with a hood safety system 21 according to the disclosure, where the hood safety system 21 is preventing a hood 2 of a vehicle 1 from being unlocked in a crash event. If for example the hood 2 or a front section 5 of the vehicle 1 is being deformed in the crash event, it is a high risk that the hood 2 is being unintentionally opened if not being properly secured to the front section 5, which may cause injuries to persons or damage to objects.

Figure 2:
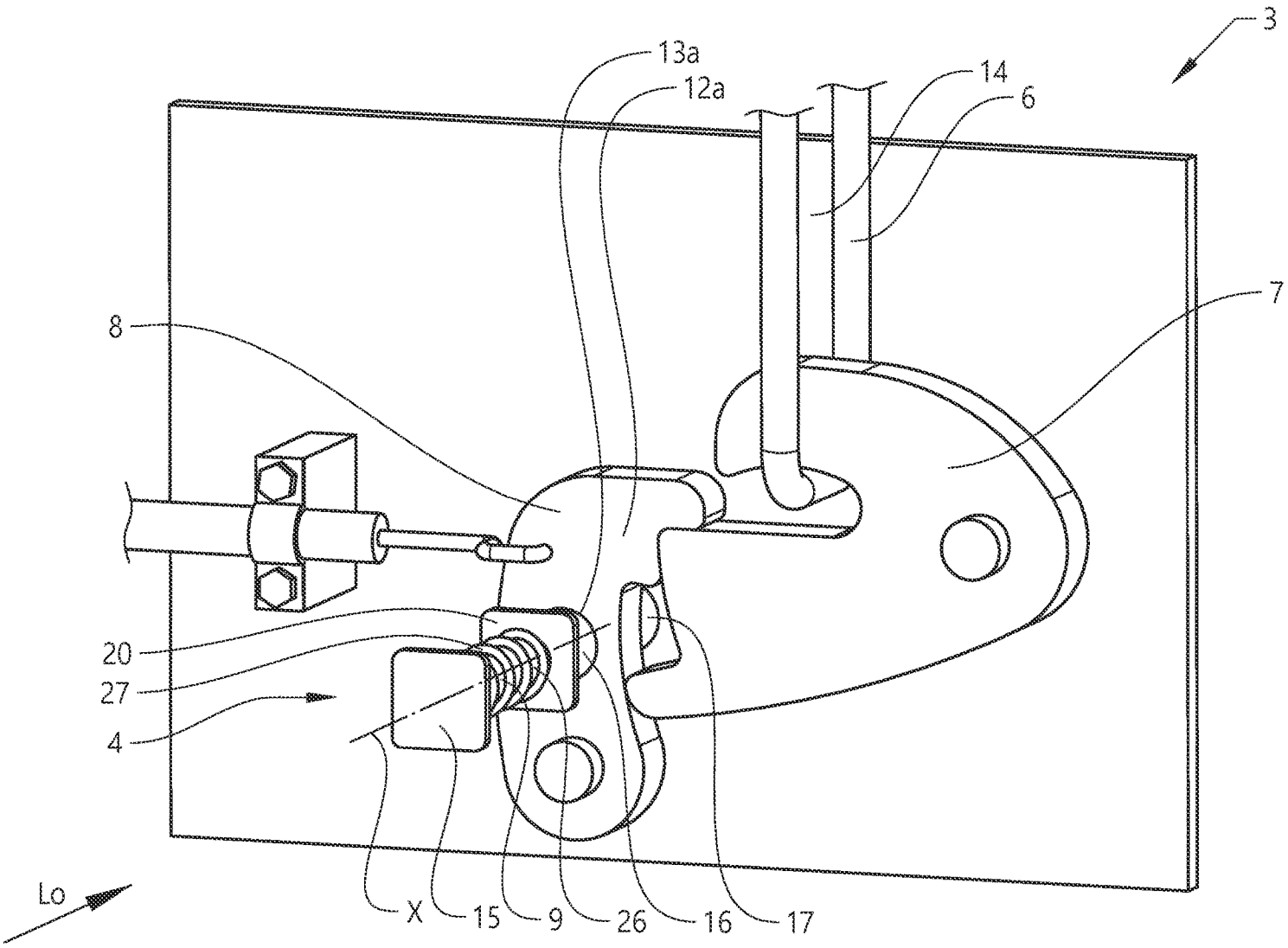
FIG. 2 shows schematically, in a perspective view the hood safety system with a crash pin in an inactivated state according to the disclosure.

As shown in FIGS. 1 and 2, the vehicle 1 is having an extension in a longitudinal direction Lo and a lateral direction La, and the hood safety system 21 comprises a hood locking mechanism 3 and a crash safety mechanism 4. The hood locking mechanism 3 and the crash safety mechanism 4 are attached to a front structure 18, such as a front frame structure or similar structural configuration, in the front section 5 of the vehicle 1. The hood locking mechanism 3 and the safety mechanism 4 are configured to cooperate with each other to prevent that the hood locking mechanism 3 is unlocked in the crash event, which may lead to unintentional opening of the hood 2, as will be further described below.

The hood 2 is normally locked to the front section 5 with the hood locking mechanism 3, and the hood locking mechanism 3 is preventing that the hood 2 is unintentionally displaced from a locked position to an unlocked position, for example when the vehicle 1 is moving, or preventing that the hood 2 is opened by unauthorized persons when the vehicle 1 is in a standstill position or being parked. In FIG. 1, the hood 2 is in the locked position. With an unlocked position of the hood 2 is meant a position where the hood 2 is not in engagement with the hood locking mechanism 3, and where the hood 2 is free to be moved in relation to the front structure 18. The hood locking mechanism 3 is also designed to unlock the hood 2 for giving access to an engine compartment or similar structure of the vehicle. The hood locking mechanism 3 is through manual action from a user configured to releasing the hood 2 of the vehicle 1 from the locked hood position to the unlocked hood position, and the hood locking mechanism 3 is then displaced from a locked position P1 to an unlocked position P3. In the locked position P1 of the hood locking mechanism 3, the hood 2 is locked to the front structure 18 and prevented from being opened. In the unlocked position P3 of the hood locking mechanism 3, the hood 2 is released from the front structure 18 and in the unlocked position P3 it is possible for the user of the vehicle or another person to open the hood in order to have access to the engine compartment.

Figure 5B:
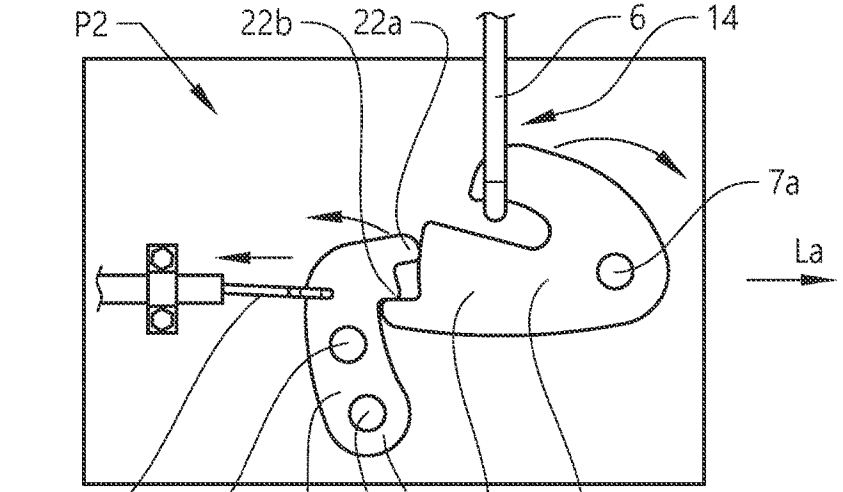
FIG. 5A-5C show schematically, in front views a hood locking mechanism in a locked position, an intermediate locked position and in an unlocked position according to the disclosure.
Figure 5A:
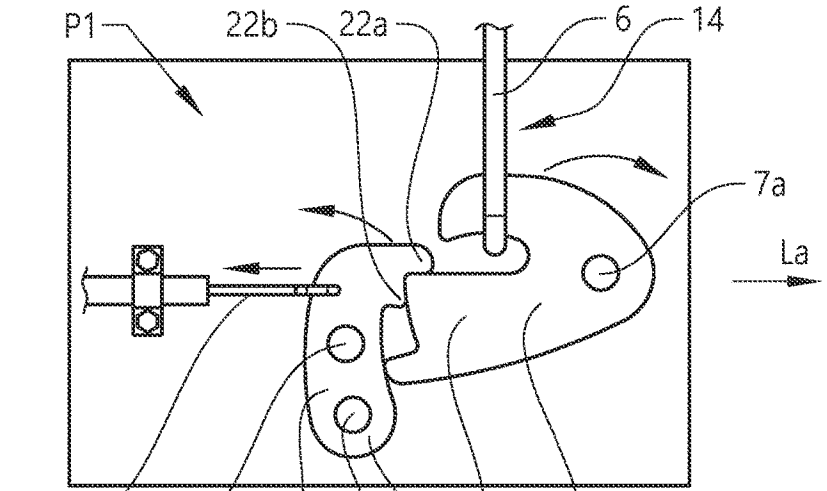
Figure 5C:
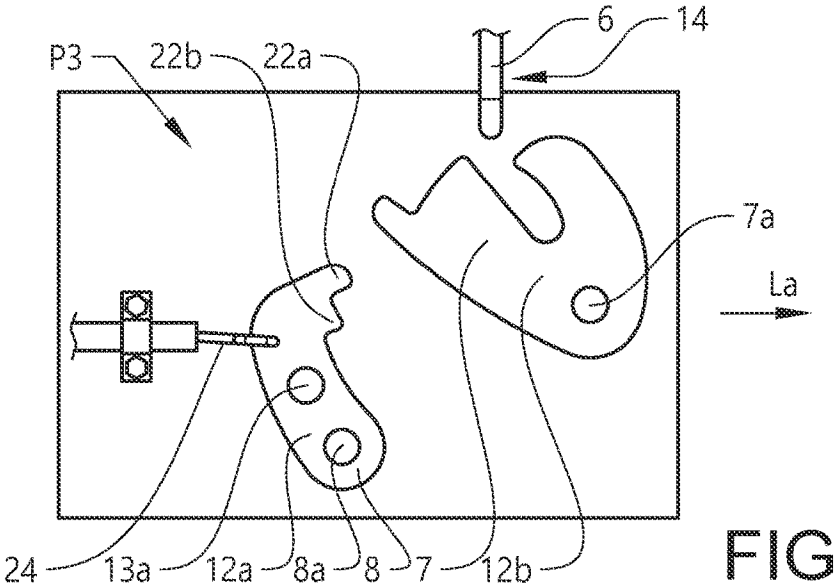

In FIGS. 5A-5C, details of the hood locking mechanism 3 are shown in schematic front views. In FIGS. 5A-5C, the crash pin 9 is not shown. The hood locking mechanism 3 comprises a latch 7 and a pawl 8. A striker 6 is attached to the hood 2 of the vehicle 1 and the striker 6 is arranged to interact with the latch 7. The latch 6 may be of any suitable construction and is following the hood 2 when the hood 2 is moved between the locked and the unlocked positions. The latch 7 and the pawl 8 are arranged in connection to each other in the front section 5 of the vehicle 1 and may for example be integrated in the front structure 18 and positioned below the hood 2, as illustrated in FIG. 1. The latch 7 and the pawl 8 may for example be arranged in a conventional way in a lock housing structure or similar arrangement to form a locking unit that is attached to the front structure 18. The latch 7 is arranged for engaging the striker 6 in the locked position P1, as shown in FIG. 5A, and also in an intermediate locked position P2, as shown in FIG. 5B, of the hood locking mechanism 3. The hood locking mechanism 3 can be moved to the unlocked position P3, where the striker 6 is released from the latch 7, as shown in FIG. 5C. In this way the hood 2 via the striker 6 can be positioned from the locked position to the unlocked position, when the hood locking mechanism 3 is being displaced from the locked position P1 to the intermediate locked position P2, and further to the unlocked position P3. Since the striker is connected to the hood 2 and also is in engagement with the hood locking mechanism 3 in the locked position P1 and the intermediate locked position P2, also the hood 2 is in the same way as the hood locking mechanism 3 displaced from the locked hood position to the unlocked hood position via an intermediate locked hood position. However, in the unlocked hood position, the striker 6 is not in engagement with the hood locking mechanism 3.

Thus, the hood locking mechanism 3 comprises the latch 7 and the pawl 8, and the hood locking mechanism 3 is cooperating with the striker 6 attached to the hood 2. In the locked position P1 of the hood 2 the latch 7 is engaging the striker 6 and the pawl 8 is locking the latch 7, preventing the hood 2 from being unlocked. In the unlocked position P3 of the hood 2 the pawl 8 is unlocking the latch 7 allowing the striker 6 to being disengaged from the latch 7.

The hood locking mechanism 3 is a double-pull action hood unlocking mechanism, where the hood locking mechanism 3 through a manual double-pull action from the user is releasing the hood 2 of the vehicle 1 from the locked position P1 to the unlocked position P3. The double-pull action unlocking mechanism is opening the hood 2 and unlocking and the hood locking mechanism 3 from the locked position P1 via the intermediate locked position P2 to the unlocked position P3 through the double-pull action from the user. An opening handle 23 arranged within an interior structure of the vehicle 1 is used for displacing the hood locking mechanism 3 into the different positions, and the opening handle 23 is connected to the hood locking mechanism 3 with for example a Bowden cable 24, as schematically illustrated in FIG. 1. When the user is pulling the opening handle 23 in a first unlocking sequence, the hood locking mechanism 3 is displaced from the locked position P1 to the intermediate locked position P2. Thereafter, the opening handle 23 needs to be released and then pulled again by the user in a second unlocking sequence to displace the hood locking mechanism 3 from the intermediate locked position P2 to the unlocked position P3.

The hood locking mechanism 3 is, as described above, designed to be arranged in three different positions, where the striker 6 in the different positions is having different engagement positions in relation to the latch 7. During unlocking, the hood locking mechanism 3 is through the first unlocking sequence and the second unlocking sequence moving from the locked position P1, as shown in FIG. 5A, to the unlocked position P3, as shown in FIG. 5C. The hood locking mechanism 3 is having the intermediate locked position P2 after the first unlocking sequence, between the locked position P1 and the unlocked position P3 to prevent unintentional opening of the hood 2, for example if the opening handle 23 is unintentionally activated. The three different positions are providing a safe hood locking and unlocking system, and the hood locking mechanism 3 is displaced from the locked position P1 to the unlocked position P3 in the two unlocking sequences as described above. The intermediate locked position P2 is securing that the hood locking mechanism 3 is not being displaced to the unlocked position P3 in only one step which could cause accidents if the hood 2 is unintentionally moved to the unlocked position, for example during driving. The intermediate locking position P2 is thus configured so that the hood locking mechanism 3 is not displaced directly from the locked position P1 to the unlocked position P3. In the locked position P1 the latch 7 is securing that the striker 6 is engaged and that the hood 2 cannot be opened. In the intermediate locked position P2, the latch 7 is still engaging the striker 6 preventing that the hood 1 is moved to the unlocked position.

The hood safety system 21 is designed to provide a simple way for unlocking the hood 2 of the vehicle 1, where the method for preventing the hood from being unlocked in a crash event is convenient to the user of the vehicle 1 and fulfils the safety regulations. According to the disclosure, the hood safety system 21 is configured as a double-pull action unlocking mechanism. The user is with the hood locking mechanism 21 not required to unlock the hood 2 at the front section 5 of the vehicle as for example with traditional single-pull systems. Thus, the method is providing a convenient opening of the hood compared to single-pull systems with the same safety level.

The latch 7 is arranged to being displaced when the hood locking mechanism 3 is moving from the locked position P1, as shown in FIG. 5A, to the intermediate locked position P2, as shown in FIG. 5B, and further displaced when the hood locking mechanism 3 is moving from the intermediate locked position P2 to the unlocked position P3, as shown in FIG. 5C. In the locked position P1 and the intermediate locked position P2, the latch 7 is in locking engagement with the striker 6, and in the unlocked position P3 the latch 7 is disengaged from the striker 6. The latch 7 is configured so that it can pivot or rotate around a latch axis 7*a* between the different positions. The latch axis 7*a* may for example be attached to the lock housing structure and the latch 7 is rotatably arranged around the latch axis 7*a* in relation to the lock housing structure.

As shown in FIGS. 5A-5C, the pawl 8 is arranged to interact with the latch 7 in the locked position P1 and the intermediate locked position P2. The pawl 8 is in the embodiment shown arranged with a first pawl locking surface 22*a* that is in engagement with the latch 7 in the locked position P1, and a second pawl locking surface 22*b* that is in engagement with the latch 7 in and the intermediate locked position P2. The a first pawl locking surface 22*a* and the second pawl locking surface 22*b* are preventing that the latch 7 can rotate around the latch axis 7*a* in the respective positions. The pawl 8 is configured so that it can rotate around a pawl axis 8*a* when the hood locking mechanism 3 is being displaced between the locked position P1 and the intermediate locked position P2, and when the hood locking mechanism 3 is being displaced between the intermediate locked position P2 and the unlocked position P3. In the unlocked position P3, both the first pawl locking surface 22*a* and the second pawl locking surface 22*b* are disengaged from the latch 7. The first pawl locking surface 22*a* and the second pawl locking surface 22*b* may be arranged on suitable parts of the pawl 8 and are designed to interact with the latch 7 so that the latch 7 cannot move when the pawl 8 is in engagement with the latch 7. The pawl axis 8*a* may for example be attached to the lock housing structure and the pawl 8 is rotatably arranged around the pawl axis 8*a* in relation to the lock housing structure. The pawl 8 can be connected to the opening handle 23 through the Bowden cable 24, which opening handle 23 when being activated in the unlocking sequences is moving the pawl 8 and the hood locking mechanism 3 from the locked position P1 to the intermediate locked position P2 and further to the unlocked position P3. The unlocking sequences are as described above manually initiated by the user of the vehicle 1 through a pulling action of the opening handle 23.

The latch 7 may be provided with a repositioning arrangement to move the latch 7 into the different positions when the hood locking mechanism 3 is being displaced from the locked position P1 to the unlocked position P3 via the intermediate locked position P2. When the pawl 8 in the first unlocking sequence is being displaced in relation to the latch 7, the latch 7 is being moved from the position shown in FIG. 5A to the position shown in FIG. 5B through the repositioning arrangement. When the pawl 8 in the second unlocking sequence is being disengaged from the latch 7, the latch 7 is being moved from the position shown in FIG. 5B to the position shown in FIG. 5C through the repositioning arrangement. A compression spring, an extension spring, a torsion spring, or other suitable mechanism may be used as the repositioning arrangement for the latch 7.

To close the hood 2 when the hood is in the unlocked position, the hood 2 is manually displaced by the user in a closing direction of the hood 2, which normally is in a downwards direction. When displacing the hood 2 in the closing direction, the striker 6 is engaging the latch 7 so that the hood locking mechanism 3 is moving from the unlocked position P3 via the intermediate locked position P2 to the locked position P1. The closing of the hood is in this way a mechanical operation without the need for electric power. However, it may be possible depending on the design of the vehicle to have, instead of the manual closing of the hood 1, an electric actuator that is moving the hood 1 in the closing direction.

The pawl 8 may be provided with a return arrangement to move the pawl 8 from the position shown in FIG. 5C to the position shown in FIG. 5A when the hood locking mechanism 3 is being displaced from the unlocked position P3 to the locked position P1. A compression spring, an extension spring, a torsion spring, or other suitable mechanism may be used as the return arrangement for the pawl 8.

The crash safety mechanism 4 comprises a crash pin 9, and the crash pin 9 is displaceable between an inactivated state IS and an activated state AS. In the inactivated state IS the crash pin 9 is disengaged from the hood locking mechanism 3. Under normal circumstances, such as when the vehicle is moving or is in a standstill position, the crash pin 9 is in the inactivated state IS. In the inactivated state IS the crash pin 9 is not interfering with the normal functionality of the hood locking mechanism 3 and the hood 2. In the inactivated state IS, the hood locking mechanism 3 can be displaced from the locked position P1 to the intermediate locked position P2, and further to the unlocked position P3, where the hood 2 can be opened. In the inactivated state IS it is also possible to close the hood 2, which closing of the hood 2 is displacing the hood locking mechanism 3 from the unlocked position P3 to the locked position P1.

In the activated state AS the crash pin 9 is engaging the hood locking mechanism 3 and preventing the hood locking mechanism 3 from displacing the hood 2 into the unlocked position. The crash pin 9 is thus configured to, in the activated state, to interact with the hood locking mechanism 3 and through the interaction with the hood locking mechanism 3 prevent that the hood 2 is opened.

The front section 5 of the vehicle 1 is when being deformed in a crash event configured to mechanically displace the crash pin 9 from the inactivated state IS to the activated state AS. During the deformation of the front section 5 of the vehicle 1 in the crash event, the front section 5 in normal frontal collision situations or crash events is pushed rearwards in relation to the vehicle body construction in at least a direction along the longitudinal direction Lo of the vehicle 1. The deformation force on the front section 5 is used for mechanically displacing the crash pin 9 from the inactivated state IS to the activated state AS.

Figure 3B:
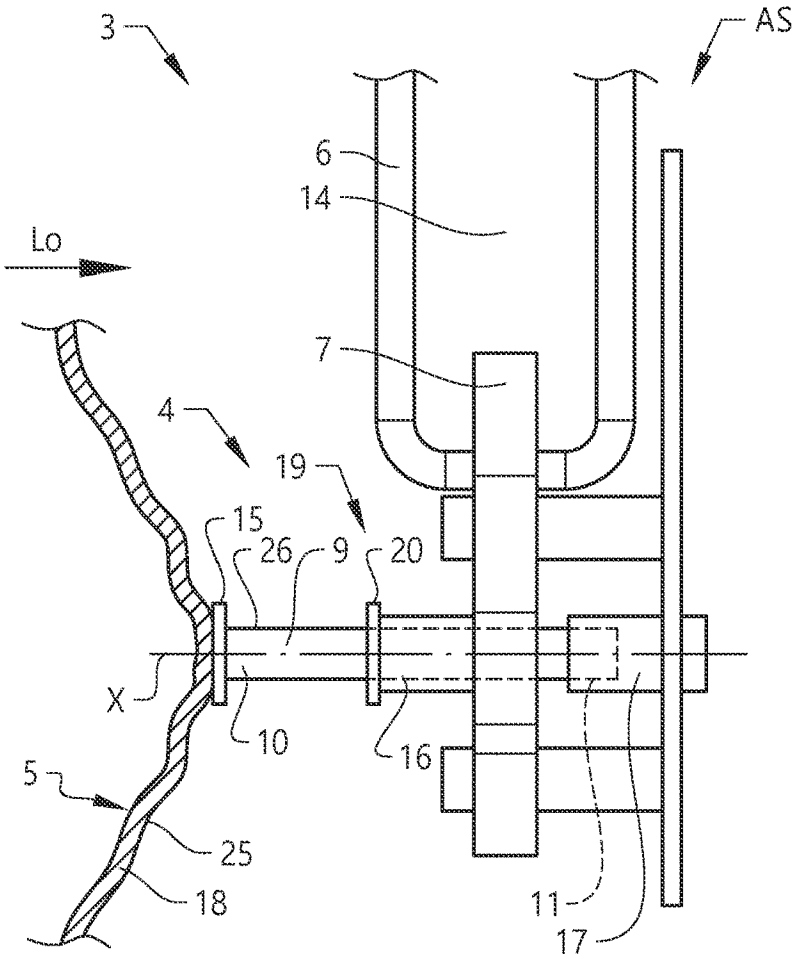
FIG. 3B shows schematically, in a side view the hood safety system with the crash pin in an activated state with a small degree of deformation of a front section according to the disclosure.
Figure 3A:
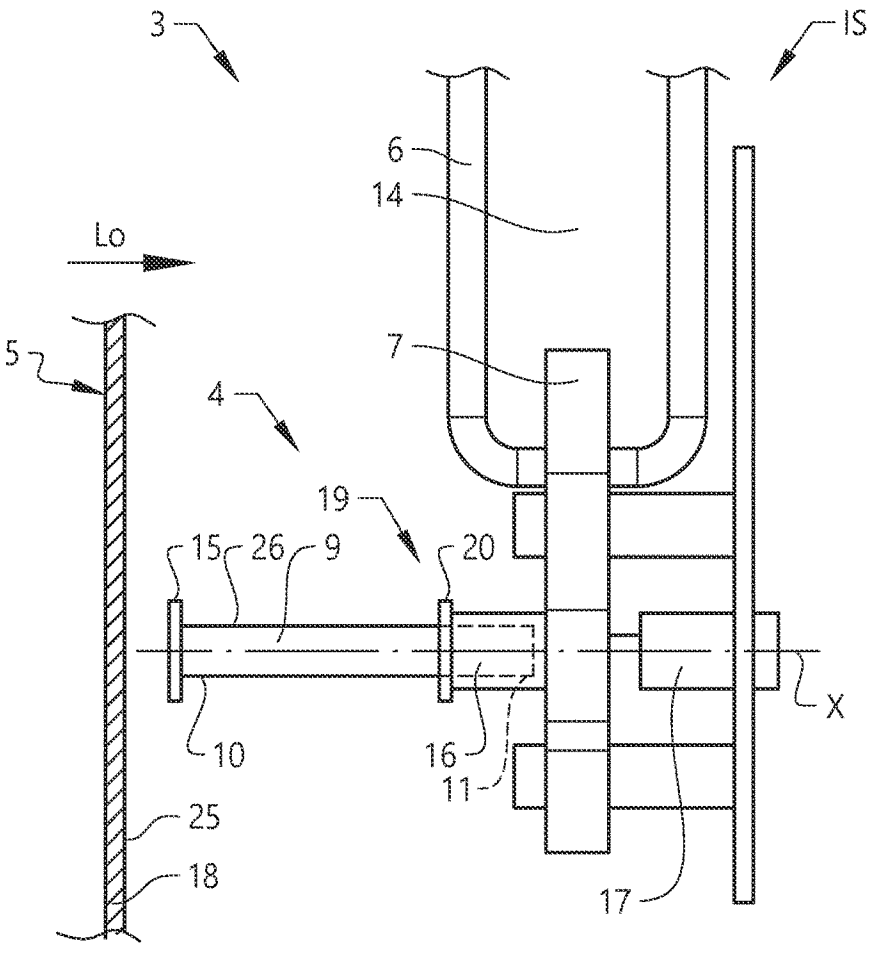
FIG. 3A shows schematically, in a side view the hood safety system with the crash pin in an inactivated state according to the disclosure.

As shown in the figures, the crash pin 9 has an elongated shape extending in a direction along an axis X, where the axis X of the crash pin 9 is extending in the longitudinal direction Lo of the vehicle 1. The crash pin 9 has a front part 10 arranged to engage the front section 5 of the vehicle 1 during the crash event. The crash pin 9 is arranged in connection to a constructional part of the front structure 18 of the front section 5, as shown in FIG. 3A. In FIG. 3A there is no deformation on the front structure 18. When the front section 5 has no deformation the crash pin 9 of the hood safety system 21 is in the inactivated state IS, where the crash pin 9 is disengaged from the hood locking mechanism 3. The constructional part of the front section 18 may for example be a beam or similar deformation element designed to be deformed in the crash event when absorbing energy from the crash forces exerted on the front section 5 of the vehicle 1. The crash pin 9 may when there is no deformation on the front structure 18 be arranged so that there is a gap between the front part 10 of the crash pin 9 and an inner deformation surface 25 of the front structure 18, as shown in FIG. 3A. The front part 10 may as an alternative be arranged in direct contact with the inner deformation surface 25 of the front structure 18. The inner deformation surface 25 may be arranged as a section of the front structure 5 of the vehicle 1 that is part of the front structure 18, and configured to being deformed in the crash event. The inner deformation surface 25 may for example be a beam structure, a sheet structure or other structure that is engaging the crash pin 9 in the crash event. In FIG. 3A, the front structure 18 is schematically shown as a part of the front section 5, and during the crash event the inner deformation surface 25 of the front structure 18 will be deformed rearwards in the longitudinal direction as illustrated with the arrow in FIG. 3A.

The crash pin has an elongated body 26 and the front part 10 of the crash pin 9 is as shown in FIG. 3A provided with a pressure plate 15. The pressure plate 15 is arranged to engage the front section 5 of the vehicle 1 during the crash event, and the pressure plate 15 is configured to interact with the inner deformation surface 25 of the front structure 18 during the crash event. The pressure plate 15 is attached to the front part 10 and has a larger area than the body 26 of the crash pin 9 in a front view of the vehicle 1 to distribute the forces exerted on the crash pin 9 in the crash event, as shown in FIG. 2. In the embodiment shown in FIG. 2 the pressure plate 15 has a square shape, but in alternative embodiments the pressure plate 15 may have any suitable regular or irregular shape depending on the construction of the crash pin 9 and the front section 5 of the vehicle 1, such as for example circular, oval, rectangular, or triangular shapes. The body 26 of the crash pin 9 has in the embodiment shown in FIG. 2 a circular cross-sectional shape, and the crash pin 9 may be of a solid construction or alternatively of a hollow construction. In alternative embodiments, the body 26 of the crash pin 9 may have any suitable regular or irregular shape depending on the construction of the crash pin 9, such as for example oval, square, rectangular, or triangular shapes. The crash pin 9 with the pressure plate 15 can be made of any suitable material, such as for example metals, plastic materials, composite materials or combinations of different materials. The crash pin 9 with the pressure plate 15 can be manufactured in one single piece of material or assembled from two or more parts.

Figure 3C:
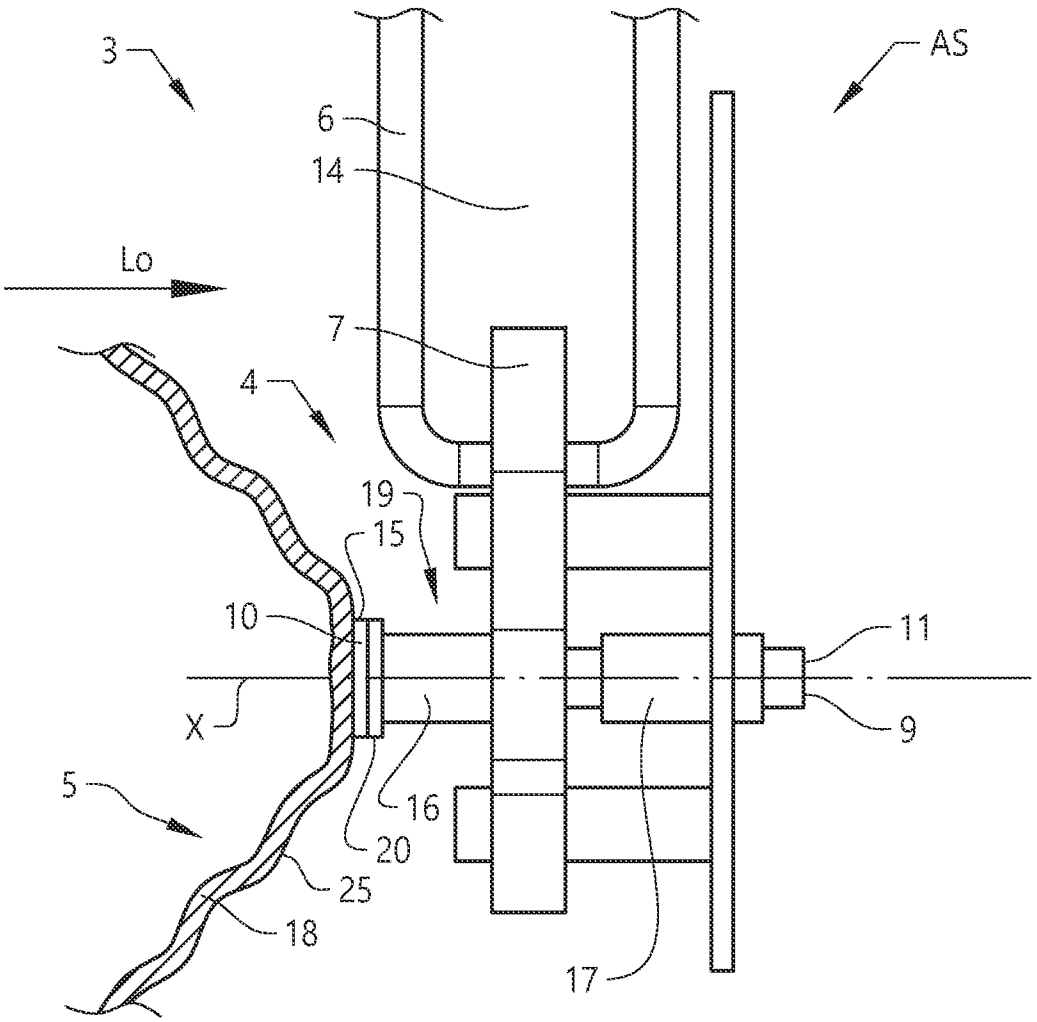
FIG. 3C shows schematically, in a side view the hood safety system with the crash pin in an activated state with a high degree of deformation of the front section according to the disclosure.

During the crash event the crash pin 9 is arranged to translate in the longitudinal direction Lo of the vehicle 1 from the inactivated state IS to the activated state AS. As shown in FIGS. 3A-3C, a rear part 11 of the crash pin 9 is arranged to engage the hood locking mechanism 3 in the activated state AS. The function of the crash pin 9, and the interaction between the crash pin 9 and the hood locking mechanism 3 will be described more in detail below.

The pawl 8 is provided with a pawl body 12*a*, and as shown in the embodiment in FIGS. 5A-5C the pawl body 12*a* has a flat configuration with an extension in the lateral direction La of the vehicle 1. The pawl body 12*a* is provided with a pawl opening 13*a* extending through the pawl body 12*a* for receiving the crash pin 9 in the crash event, and in the activated state AS the crash pin 9 is engaging the pawl opening 13*a*. Through the engagement between the crash pin 9 and the pawl opening 13*a* the hood locking mechanism 3 is prevented from releasing the hood 2 to the unlocked position. In the activated state AS, the crash pin 9 is when engaging the pawl opening 13*a* blocking the movement of the pawl 8 so that the pawl 8 is preventing the latch 7 from being displaced. The pawl opening 13*a* may have a circular shape or other suitable shape depending on the design of the crash safety mechanism.

The crash safety mechanism 4 further comprises a front guide part 16, and the front guide part 16 is arranged for guiding the crash pin 9 during the crash event. The front guide part 16 is attached to the front structure 18 of the vehicle 1 in front of the hood locking mechanism 3, and has a tubular or tubular-like shape extending in the longitudinal direction Lo of the vehicle 1. The crash pin 9 is extending inside the front guide part 16 in the inactivated state IS and the activated state AS, and the front guide part 16 is guiding the crash pin 9 in the longitudinal direction Lo when the crash pin 9 is displaced from the inactivated state IS to the activated state AS. In this way the displacement of the crash pin in the longitudinal direction between the inactivated state IS and the activated state AS is steered and controlled by the front guide part 16. Thus, in the inactivated state IS the crash pin 9 is positioned inside the front guide part 16 and when the inner deformation surface 25 of the front structure 18 is deformed the crash pin 9 is being displaced from the inactivated state IS to the activated state AS inside the front guide part 16. During the deformation, the crash pin 9 is moving in a direction backwards and the front guide part 16 is ensuring that the crash pin 9 is securely held in the right position during the deformation and displacement process.

The front guide part 16 is securing that the displacement of the crash pin 9 during the crash event is guided so that the crash pin 9 is engaging the hood locking mechanism 3 and preventing that the hood locking mechanism 3 is displacing the hood 2 into the unlocked position P3. The crash pin 9 is arranged inside the front guide part 16, and the tubular or tubular-like shape is used for guiding the crash pin during the crash event when the front section is deformed. The tubular construction is providing a simple and reliable design of the front guide part 16 that is cooperating with the circular cross-sectional shape of the body 26 of the crash pin 9. If the body 26 of the crash pin 9 is having other cross-sectional shapes than circular, the front guide part 16 may instead of the tubular shape have an inner shape that is matching the crash pin 9.

A front end 19 of the front guide part 16 is provided with a stop plate 20. The stop plate 20 is arranged for preventing further movement of the crash pin 9 when the crash pin 9 has reached the activated state AS and when the inner deformation surface 25 of the front structure 18 has a high degree of deformation, as shown in FIG. 3C. In the activated state AS, the stop plate 20 is engaging the pressure plate 15 of the crash pin 9. The stop plate 20 is securing that the crash pin 9 is not displaced a too long distance where the crash pin 9 is no longer engaging the hood locking mechanism 3, which could cause a malfunction of the system during the crash event. If for example the crash pin 9 is moving past the hood locking mechanism 3, the desired function is not achieved. The stop plate 20 of the front guide part 16 is interacting with the pressure plate 15 so that the crash pin 9 has the correct locking position in the crash event.

The crash safety mechanism 4 further comprises a rear guide part 17, and the rear guide part 17 is arranged for guiding the crash pin 9 during the crash event. The rear guide part 17 is securing that the displacement of the crash pin 9 during the crash event is achieved in a correct manner so that the crash pin 9 is engaging the hood locking mechanism 3 and preventing that the hood locking mechanism 3 is displacing the hood 2 into the unlocked position.

Figure 4A:
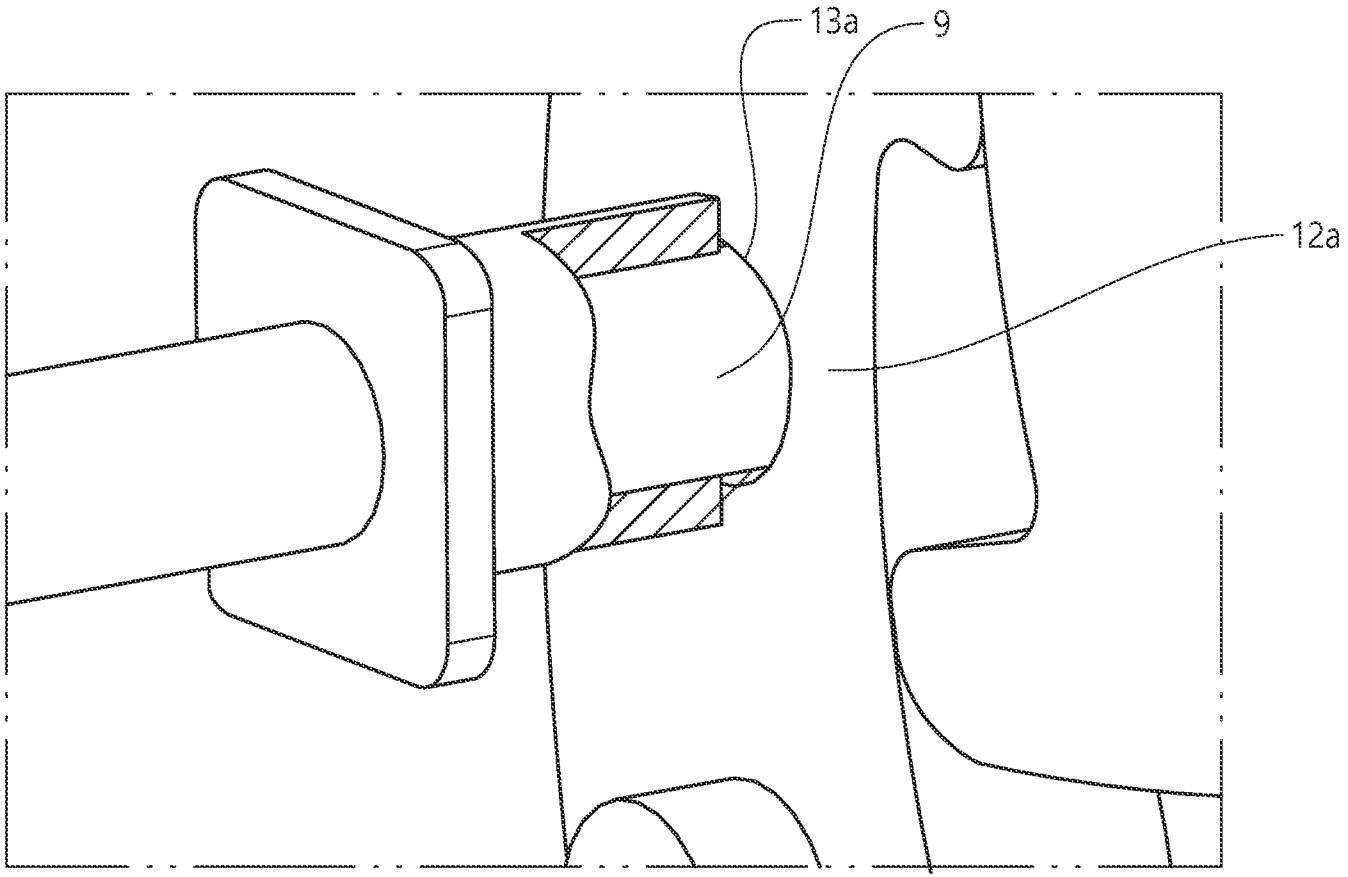
FIG. 4A-4C show schematically, in perspective views the hood safety system where the crash pin is engaging the pawl, the latch, and the striker in the activated state according to the disclosure.

The rear guide part 17 is attached to the front structure 18 of the vehicle 1 behind the hood locking mechanism 3, and has a tubular or tubular-like shape extending in the longitudinal direction Lo of the vehicle 1. The crash pin 9 is in the activated state AS extending inside the rear guide part 17, and the rear guide part 17 is guiding the crash pin 9 in the longitudinal direction Lo when the crash pin 9 is displaced from the inactivated state IS to the activated state AS. Thus, when the inner deformation surface 25 of the front structure 18 is deformed, the crash pin 9 is being displaced from the inactivated state IS to the activated state AS, and when the rear part 11 of the crash pin 9 has engaged the pawl opening 13*a*, as shown in FIG. 4A, the crash pin 9 is further moving into the rear guide part 17. The rear guide part 17 is in this way ensuring that the crash pin 9 is securely held in place during the deformation process. The crash pin 9 is arranged inside the rear guide part 17 in the activated state, as shown in FIGS. 3B and 3C, and the tubular or tubular-like shape is used for guiding the crash pin 9 during the crash event when the front section 5 is deformed. The tubular construction is providing a simple and reliable design of the rear guide part 17 that is cooperating with the circular cross-sectional shape of the body 26 of the crash pin 9. If the body 26 of the crash pin 9 is having other cross-sectional shapes than circular, the rear guide part 17 may instead of the tubular shape have an internal shape that is matching the crash pin 9.

When the front section 5 of the vehicle 1 is deformed in the crash event, the inner deformation surface 25 of the front structure 18 is through the deformation pushed in a direction backwards. In FIG. 3*a* the front structure 18 is in a non-deformed state with the crash pin 9 in the inactivated state IS, where the crash pin 9 is disengaged from the hood locking mechanism 3. In FIGS. 3B and 3C the front structure 18 is in a deformed state with the crash pin 9 in the activated state, where the crash pin 9 is in engagement with the hood locking mechanism 3. In FIG. 3B the front structure 18 has a small degree of deformation, and in FIG. 3C the front structure 18 has a high degree of deformation. During the crash event, the whole front structure 18 of the vehicle 1 may be deformed and displaced in a direction backwards due to the forces acting on the front section 5 of the vehicle 1. This may lead to a displacement also of the hood locking mechanism 3, the crash safety mechanism 4, since they are connected to the front structure 18. Also the hood 2 and the striker 6 may be displaced during the crash event. Thus, in FIGS. 3B and 3C, the relative displacement of the inner deformation surface 25 of the front structure 18 in relation to the hood locking mechanism 3, the crash safety mechanism 4, and the striker 6 is shown.

The deformed state with a small degree of deformation of the front structure 18, as shown in FIG. 3B, may occur after the crash event if the deformation forces are leading to a smaller deformation of the front structure 18. The crash pin 9 will with the small degree of deformation of the front structure 18 only be displaced a shorter distance into the pawl opening 13*a*, and in this state the crash pin 9 has not been displaced the maximum possible displacement length in the longitudinal direction Lo. However, the crash pin 9 will be in the activated state AS, since the crash pin 9 is preventing the hood locking mechanism 3 from displacing the hood 2 into the unlocked position. The deformed state in FIG. 3B could also be an intermediate deformation state when the front structure 18 is exposed to high deformation forces leading to a high degree of deformation, and the intermediate deformation is then a momentary state during the deformation process.

The deformed state with a high degree of deformation of the front structure 18, as shown in FIG. 3C, may occur after the crash event if the deformation forces are leading to a large deformation of the front structure 18. The crash pin 9 will with the high degree of deformation of the front structure 18 be displaced the maximum possible distance into the pawl opening 13*a*. The crash pin 9 will be in the activated state AS, and the crash pin 9 is preventing the hood locking mechanism 3 from displacing the hood 2 into the unlocked position. As further shown in FIG. 3C, the crash pin 9 is prevented from further displacement in the longitudinal direction Lo, since the stop plate 20 of the front guide part 16 is preventing further movement of the crash pin 9 since the stop plate 20 is engaging the pressure plate 15 of the crash pin 9.

Figure 4B:
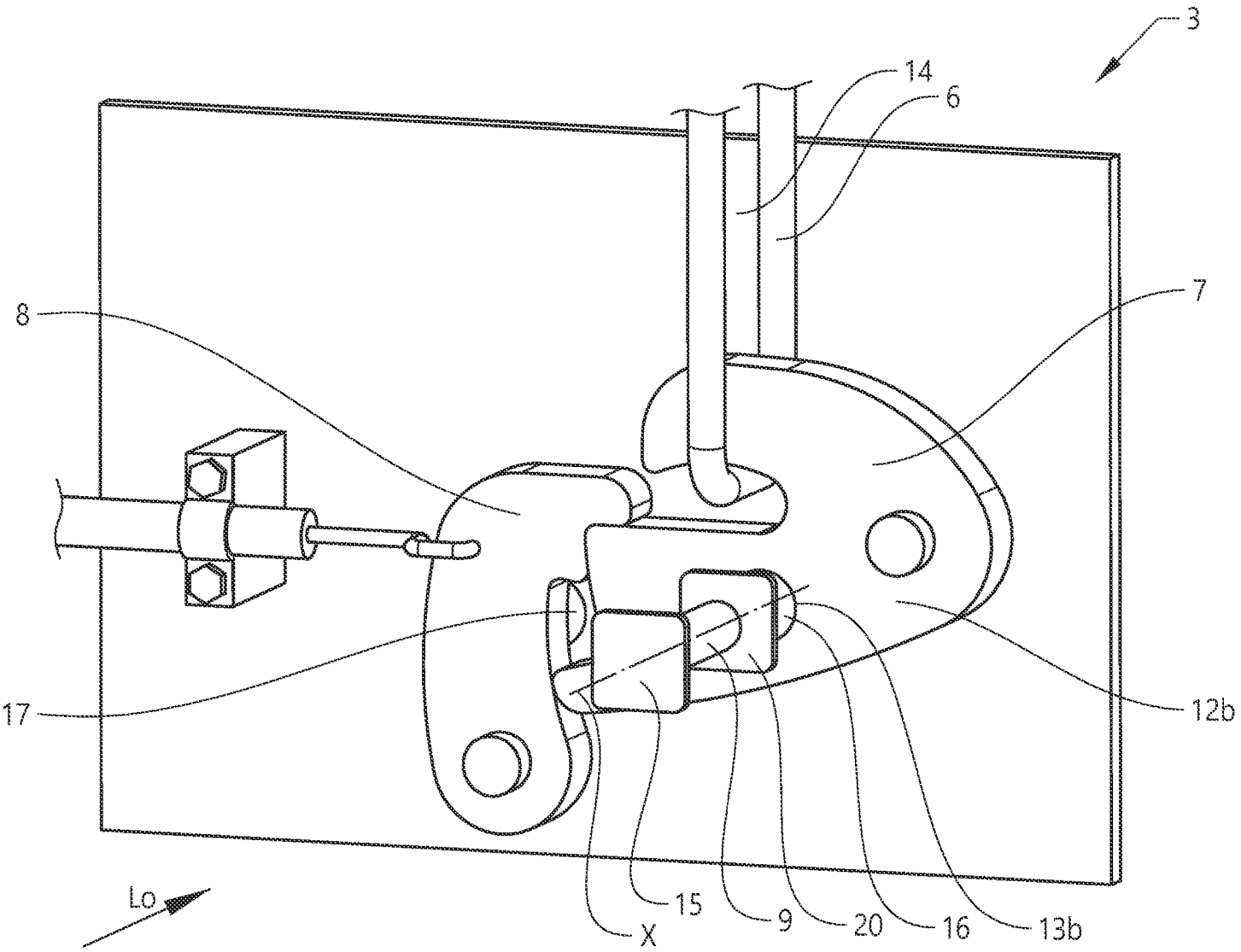

In an alternative embodiment, the latch 7 is provided with a latch body 12*b* having a flat configuration with an extension in the lateral direction La of the vehicle 1, where the latch body 12*b* is provided with a latch opening 13*b* extending through the latch body 12*b* for receiving the crash pin 9, as schematically illustrated in FIG. 4B. In this embodiment, the crash pin 9 in the activated state AS is engaging the latch opening 13*b* instead of the pawl opening 13*a*. The engagement between the crash pin 9 and the latch opening 13*b* is in the same way as described above in relation to the pawl opening 13*a* preventing the hood locking mechanism 3 from releasing the hood 2 to the unlocked position. In this embodiment, the crash pin 9, the front guide part 16, and the rear guide part 17, are arranged in a position so that the crash pin 9 is engaging the latch opening 13*b* in the crash event. The latch opening 13*b* may have a circular shape or other suitable shape depending on the design of the crash safety mechanism.

As described above, the crash pin 9 has an elongated shape extending in a direction along the axis X, where the axis X of the crash pin 9 is extending in the longitudinal direction Lo of the vehicle 1. In the embodiments where the crash pin 9 is arranged for engaging the pawl opening 13*a*, or alternatively the latch opening 13*b*, the pawl body 12*a* and the latch body 12*b* have extensions in the lateral direction La. In these embodiments, the striker opening 14 is arranged in a plane extending mainly in the longitudinal direction Lo, wherein the latch 7 easily can engage the striker 6.

Figure 4C:
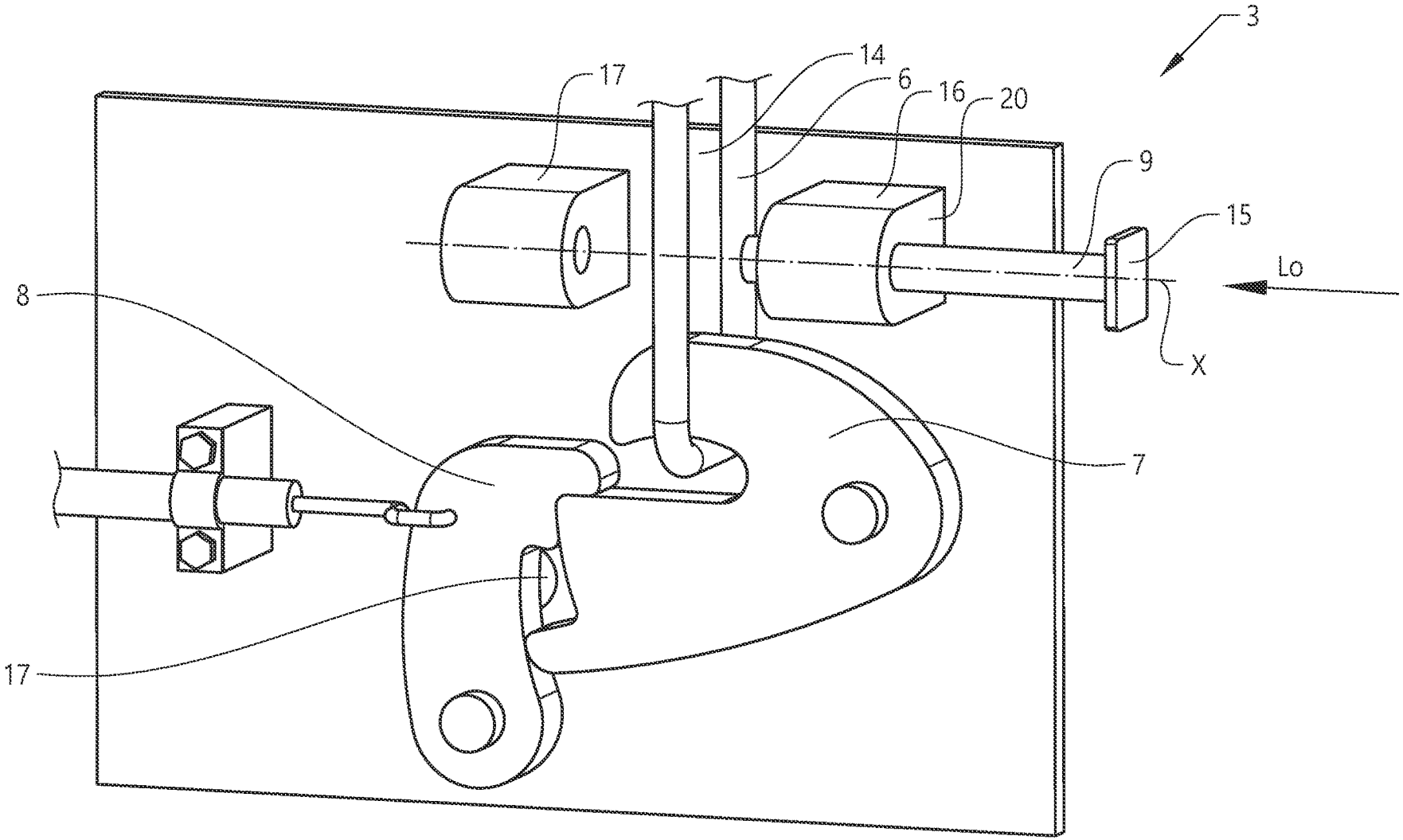

In a further alternative embodiment, the striker 6 is provided with a striker opening 14 for receiving the crash pin 9, as schematically illustrated in FIG. 4C. In the embodiments shown in the figures, the striker 6 has a conventional loop-like or shackle-like configuration with the striker opening 14 in a middle section of the striker 6. Other configurations are also possible depending on the design of the striker 6. The crash pin is in this embodiment in the activated state AS engaging the striker opening 14. The engagement between the crash pin 9 and the striker opening 14 is in the same way as described above in relation to the other embodiments preventing that the hood 2 is released to the unlocked position. The striker opening 14 may have any suitable configuration adapted for receiving the crash pin 9. In this embodiment, the crash pin 9, the front guide part 16, and the rear guide part 17, are arranged in a position so that the crash pin 9 is engaging the striker opening 14 in the crash event. In this embodiment, the crash pin 9 is engaging the striker opening 14, and the striker opening 14 is arranged in a plane extending mainly in the lateral direction La. The pawl body 12*a* and the latch body 12*b* are therefore in this embodiment extending in the longitudinal direction Lo, wherein the latch 7 easily can engage the striker 6.

As shown in FIG. 2, the crash pin 9 may further be provided with a spring arrangement 27 to prevent that the crash pin 9 is interfering with the hood locking mechanism 3 when there is no deformation of the front section 5. The spring arrangement 27 may for example push the crash pin 9 in a direction towards the front structure 18, and the spring arrangement 9 is configured to be compressed when the crash pin 9 is displaced during deformation. The spring arrangement 27 may be in the form of a conventional compression spring arranged around a part of the body 26 of the crash pin 9.

The crash pin 9 may also be provided with a suitable locking arrangement to hold the crash pin 9 in the activated position AS after the crash event, to prevent that the crash pin is displaced from the activated state.

Figure 6:
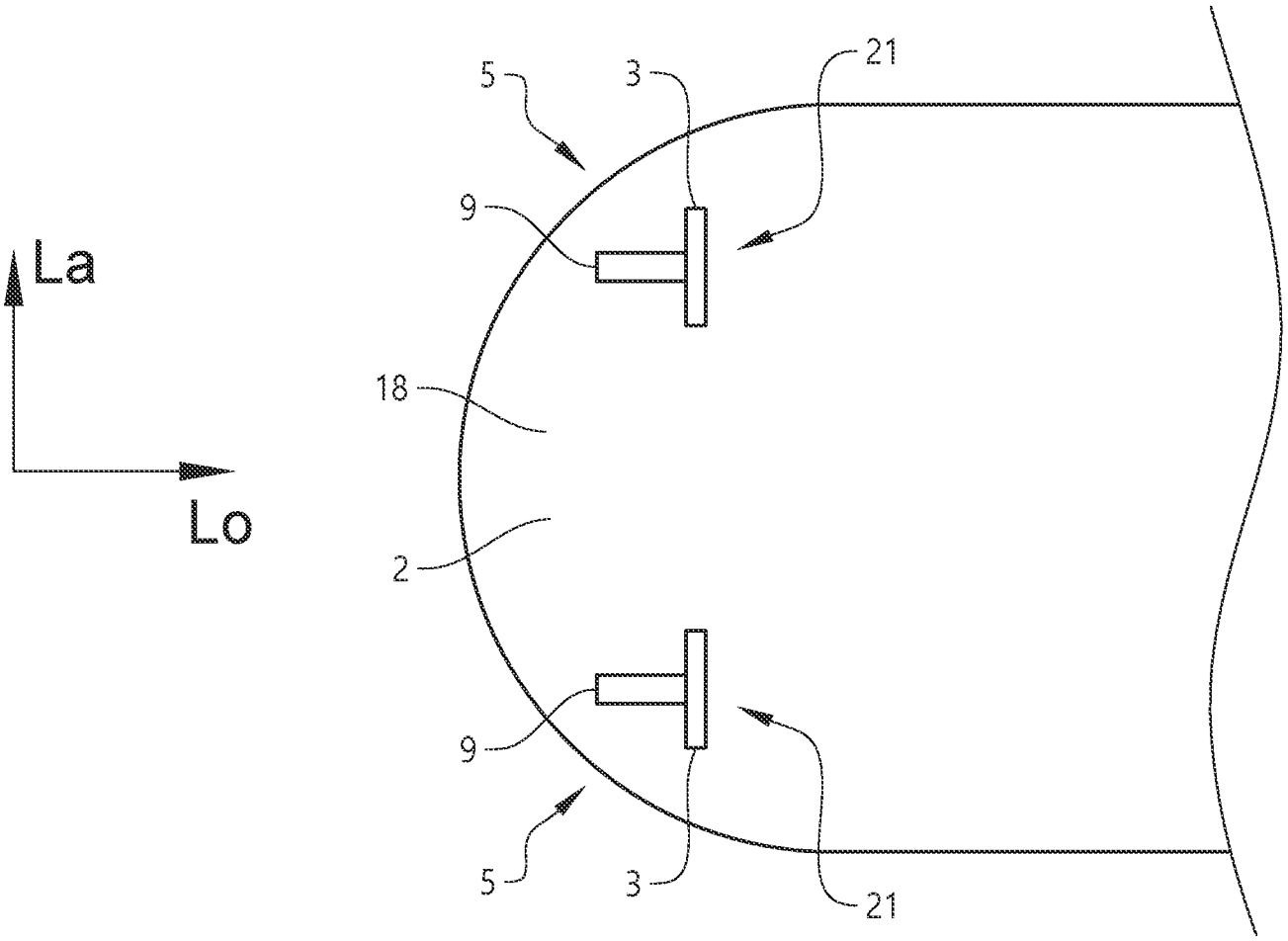
FIG. 6 shows schematically, in a view from above a vehicle hood with exemplified positions of the hood safety system according to the disclosure.

As shown in FIG. 6, the vehicle 1 may be provided with two cooperating hood locking mechanisms 3. In FIG. 6 the hood 2 is shown in a view from above. Each hood locking mechanism 3 is arranged with a crash pin 9, and the configuration and design of each of the hood locking mechanisms 3 with the crash pins 9 may be the same as described in the embodiments above. It is also possible according to the disclosure to have more than two mechanisms.

It should be understood that the hood locking mechanism 3 may have any suitable configuration and constructional design, and the configuration and design of the pawl, latch, and the striker may differ from the embodiments described above and shown in the figures. For example, the hood locking mechanism 3 may have a more compact design, where the constructional parts are positioned in an overlapping configuration. The hood locking mechanism 3 and the crash safety mechanism 4 may if desired be integrated in a common structure that is attached to the front section 5 or front structure 18 of the vehicle 1. It would be possible to use that crash pin 9 also for single-pull systems.

The parts of the hood locking mechanism 3 and the crash safety mechanism can be made of any suitable material, such as for example metals, plastic materials, composite materials or combinations of different materials.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims. Reference signs mentioned in the claims should not be seen as limiting the extent of the matter protected by the claims, and their sole function is to make claims easier to understand.

What is claimed is:

1. A hood safety system for a vehicle that has a hood and a front structure in a front section of the vehicle, the vehicle extending in a longitudinal direction and a lateral direction, the hood safety system for preventing the hood of the vehicle from being unlocked in a crash event, and the hood safety system comprising:

a hood locking mechanism configured to be attached to the front structure of the vehicle; and a crash safety mechanism configured to be attached to the front structure of the vehicle, wherein the hood locking mechanism, through manual action from a user, is configured to release the hood of the vehicle from a locked state to an unlocked state, wherein the crash safety mechanism comprises a crash pin displaceable between an inactivated state in which the crash pin is disengaged from the hood locking mechanism and an activated state in which the crash pin engages the hood locking mechanism and prevents the hood locking mechanism from releasing the hood into the unlocked state, wherein the crash pin is mechanically displaced from the inactivated state to the activated state during the crash event in which the front section of the vehicle is deformed, wherein the hood locking mechanism cooperates with a striker that is attached to the hood, and the hood locking mechanism comprises a latch and a pawl, wherein, in the locked state, the latch engages the striker and the pawl locks the latch to prevent the hood from being unlocked, wherein, in the unlocked state, the pawl unlocks the latch to allow the striker to disengage from the latch, and wherein the latch comprises a latch body extending in the lateral direction of the vehicle, and wherein the latch body has a latch opening for receiving the crash pin in the activated state so that engagement of the crash pin with the latch opening prevents the hood locking mechanism from releasing the hood to the unlocked state.

2. The hood safety system according to claim 1, wherein the crash pin has a front part arranged to engage the front section of the vehicle during the crash event, and a rear part arranged to engage the latch in the activated state.

3. The hood safety system according to claim 2, wherein the front part of the crash pin is provided with a pressure plate, and the pressure plate is arranged to engage the front section of the vehicle during the crash event.

4. The hood safety system according to claim 1, wherein the crash pin has an elongated shape extending in a direction along an axis, and the axis of the crash pin extends in the longitudinal direction of the vehicle.

5. The hood safety system according to claim 4, wherein the crash pin, during the crash event, translates in the longitudinal direction of the vehicle from the inactivated state to the activated state.

6. The hood safety system according to claim 1, wherein the crash safety mechanism further comprises a front guide part, and the front guide part is arranged for guiding the crash pin during the crash event.

7. The hood safety system according to claim 6, wherein the front guide part is attached to the front structure of the vehicle in front of the hood locking mechanism, and has a tubular shape extending in the longitudinal direction of the vehicle, wherein the crash pin extends inside the front guide part in the inactivated state and the activated state, and wherein the front guide part guides the crash pin in the longitudinal direction when the crash pin is displaced from the inactivated state to the activated state.

8. The hood safety system according to claim 6, wherein the crash pin has a front part arranged to engage the front section of the vehicle during the crash event, and a rear part arranged to engage the latch in the activated state;

wherein the front part of the crash pin is provided with a pressure plate, and the pressure plate is arranged to engage the front section of the vehicle during the crash event; and wherein a front end of the front guide part is provided with a stop plate, and the stop plate is arranged to prevent further movement of the crash pin when the crash pin has reached the activated state.

9. The hood safety system according to claim 1, wherein the crash safety mechanism further comprises a rear guide part, and the rear guide part is arranged for guiding the crash pin during the crash event.

10. The hood safety system according to claim 9, wherein the rear guide part is attached to the front structure of the vehicle behind the hood locking mechanism, and has a tubular shape extending in the longitudinal direction of the vehicle, wherein the crash pin, in the activated state, extends inside the rear guide part, and wherein the rear guide part guides the crash pin in the longitudinal direction when the crash pin is displaced from the inactivated state to the activated state.

11. The hood safety system according to claim 1, wherein the hood locking mechanism is a double-pull action hood unlocking mechanism, wherein the hood locking mechanism, through a manual double-pull action from the user, releases the hood of the vehicle from the locked state to the unlocked state.

12. A hood safety system for a vehicle that has a hood and a front structure in a front section of the vehicle, the vehicle extending in a longitudinal direction and a lateral direction, the hood safety system for preventing the hood of the vehicle from being unlocked in a crash event, and the hood safety system comprising:

a hood locking mechanism configured to be attached to the front structure of the vehicle; and a crash safety mechanism configured to be attached to the front structure of the vehicle, wherein the hood locking mechanism, through manual action from a user, is configured to release the hood of the vehicle from a locked state to an unlocked state, wherein the crash safety mechanism comprises a crash pin displaceable between an inactivated state in which the crash pin is disengaged from the hood locking mechanism and an activated state in which the crash pin engages the hood locking mechanism and prevents the hood locking mechanism from releasing the hood into the unlocked state, wherein the crash pin is mechanically displaced from the inactivated state to the activated state during the crash event in which the front section of the vehicle is deformed, wherein the hood locking mechanism cooperates with a striker that is attached to the hood, and the hood locking mechanism comprises a latch and a pawl, wherein, in the locked state, the latch engages the striker and the pawl locks the latch to prevent the hood from being unlocked, wherein, in the unlocked state, the pawl unlocks the latch to allow the striker to disengage from the latch, and wherein the pawl comprises a pawl body extending in the lateral direction of the vehicle, wherein the pawl body has a pawl opening formed by a through hole in the pawl body, and the crash pin received in the pawl opening, in the activated state so that engagement of the crash pin with the pawl opening prevents the hood locking mechanism from releasing the hood to the unlocked state.

13. A vehicle comprising a hood safety system according to claim 1.

* * * * *